252-99 AU 165 EX
4/26/77 XR 4,019,998

United States Patent [19]

Benson et al.

[11] 4,019,998

[45] Apr. 26, 1977

[54] PROCESS FOR PREPARING A PYROPHOSPHATE-SILICATE DETERGENT PRODUCT

[75] Inventors: Richard W. Benson, Cincinnati; Steven D. Cherney, Springdale; Everett J. Collier, Cincinnati, all of Ohio

[73] Assignee: The Procter & Gamble Company, Cincinnati, Ohio

[22] Filed: Sept. 29, 1975

[21] Appl. No.: 618,303

Related U.S. Application Data

[63] Continuation-in-part of Ser. No. 587,455, June 16, 1975, abandoned, which is a continuation-in-part of Ser. No. 550,058, Feb. 14, 1975, abandoned, which is a continuation-in-part of Ser. No. 509,866, Sept. 27, 1974.

[52] U.S. Cl. ..... 252/135; 252/99; 252/109; 252/131; 252/140; 252/179; 252/531; 252/539

[51] Int. Cl.[2] ..... C11D 3/06; C11D 3/08; C11D 3/12; C11D 11/02

[58] Field of Search ..... 252/99, 109, 110, 135, 252/531, 539, 131, 140, 179

[56] References Cited

UNITED STATES PATENTS

| | | | |
|---|---|---|---|
| 2,903,431 | 9/1959 | Ruff | 252/135 |
| 2,904,513 | 9/1959 | Metcalf | 252/135 |
| 2,925,390 | 2/1960 | Flitcraft | 252/116 |
| 2,941,947 | 6/1960 | Schauer | 252/135 |
| 3,112,176 | 11/1963 | Haden | 423/329 |
| 3,198,740 | 8/1965 | Dunlop | 252/531 |
| 3,629,951 | 12/1971 | Davis | 159/4 CC |
| 3,801,511 | 4/1974 | Lemoff | 252/135 |
| 3,852,211 | 12/1974 | Ohren | 252/110 |
| 3,896,056 | 7/1975 | Benjamin | 252/539 |
| 3,915,903 | 10/1975 | Wise | 252/552 |

FOREIGN PATENTS OR APPLICATIONS

| | | | |
|---|---|---|---|
| 2,433,485 | 2/1975 | Germany | 252/131 |

OTHER PUBLICATIONS

McCutcheon; J. W., "Synthetic Detergents," Published by MacNair–Dorland Co., New York, 1950, pp. 246–247.

*Primary Examiner*—Dennis L. Albrecht
*Attorney, Agent, or Firm*—Forrest L. Collins; Robert B. Aylor; Thomas H. O'Flaherty

[57] ABSTRACT

A detergent composition comprising an organic detergent, a difficultly soluble alkali metal silicate, an optional diluent, and an alkali metal pyrophosphate, and process for preparing said composition.

18 Claims, No Drawings

PROCESS FOR PREPARING A PYROPHOSPHATE-SILICATE DETERGENT PRODUCT

CROSS-REFERENCE

This application is a continuation-in-part of copending application Ser. No. 587,455, filed June 16, 1975 now abandoned which is a continuation-in-part of application Ser. No. 550,058 filed Feb. 14, 1975 now abandoned which is a continuation-in-part of copending application Ser. No. 509,866 fild Sept. 27, 1974.

BACKGROUND OF THE INVENTION

For many years the primary material used to control water hardness in detergent products has been sodium tripolyphosphate at levels of approximately 50% by weight of the finished detergent product. Within the past few years the use of high levels of sodium tripolyphosphate has come under scrutiny because of the suspicion that soluble phosphate species accelerate the eutrophication or aging process of water bodies. This eutrophication is ordinarily evidenced by the rapid growth of algae in the water body.

Sodium tripolyphosphate exists as a molecule containing 5 atoms of sodium, 3 of phosphorus, and 10 atoms of oxygen. When utilized as a detergent builder the sodium tripolyphosphate molecule sequesters as a soluble species one mole of calcium or magnesium cation per mole of tripolyphosphate anion. In other words, sodium tripolyphosphate sequesters calcium and magnesium ions on a 1:1 mole basis. The calcium or magnesium tripolyphosphate species is relatively stable in a wash solution, thus preventing the water hardness from reacting with anionic detergents which in turn gives better cleaning. The calcium or magnesium tripolyphosphate species exists essentially as a single trivalent negative anionic species in the wash solution. This calcium or magnesium trivalent anion does not precipitate in the course of the wash.

Sodium pyrophosphate has generally been considered to be an equivalent builder when compared to sodium tripolyphosphate. It has also been suspected that sodium pyrophosphate is the equivalent of sodium tripolyphosphate in promoting the eutrophication as has been discussed above.

Sodium pyrophosphate contains one less atom of phosphorus than does sodium tripolyphosphate. The foregoing is reflected in the empirical formula of sodium pyrophosphate which is 4 atoms of sodium, 2 atoms of phosphorus and 7 atoms of oxygen. Sodium pyrophosphate is also known to form a 1:1 molar complex with calcium or magnesium ions. The species resulting from the sequestration of calcium or magnesium by the tetravalent negative pyrophosphate anion is the calcium or magnesium divalent negatively charged pyrophosphate complex. This calcium or magnesium pyrophosphate complex is sufficiently stable in the wash solution to prevent the water hardness cations from interfering with the detergency process.

The pyrophosphate tetravalent anion has a high association constant with the first calcium ion with which it associates. Association constants are a measure of the stability of the complex formed. The divalent anion has a very small association constant with the second calcium ion for the formation of dicalcium pyrophosphate which is electrically neutral. In the absence of any material which makes the dicalcium pyrophosphate more stable, one of the associated calcium ions will be free to disassociate and to seek a more stable association such as with body soil on the fabrics or with the anionic detergent. The main purpose of controlling calcium ions whether free or associated in a weak complex is to prevent the last mentioned reaction with the detergent or soiled fabric from occurring. As the pyrophosphate anion strongly holds one mole of calcium ion per pyrophosphate anion it has been common practice to attempt the first association (sequestration) on a mole for mole basis. If, however, the pyrophosphate anion can be induced to strongly associate (precipitate) with two moles of calcium ion the pyrophosphate level used could be reduced substantially, and still maintain the same level of hardness control. Preferably some free pyrophosphate tetravalent anion will also be present in the wash for its value in peptizing clay soils.

Thus, in addition to the molecular weight advantage which allows more moles of the pyrophosphate salt to be present in a composition at a given fraction of phosphate than tripolyphosphate, the ability of the pyrophosphate to precipitate as the dicalcium pyrophosphate salt under normal wash conditions gives a substantially greater advantage. However, the precipitation of pyrophosphates has been viewed as undesirable in wash solutions as the salt formed has a tendency to build up on fabrics and exposed machine surfaces. Furthermore the precipitation of calcium pyrophosphate is unpredictable under normal wash conditions where such factors as the total hardness, the pH, and the ratio of calcium ions to magnesium ions may vary from load to load.

Some work has been done in an attempt to make pyrophosphate a more effective detergency builder. Johnson states in U.S. Pat. No. 2,381,960 issued Aug. 14, 1945 that water-hardness may be reduced by adding pyrophosphates to the solution containing the hardness after a supplemental alkaline material such as sodium orthophosphate, alkali metal hydroxides and carbonates, soap or sodium silicate having an $SiO_2$:-$Na_2O$ ratio greater than 1.5 has been added to the solution. Kepfer in U.S. Pat. No. 2,326,950 issued Aug. 17, 1943, discloses that pyrophosphates can be used to control water hardness if the pyrophosphate is added to the solution containing the hardness prior to the addition of certain specific supplemental alkaline materials such as sodium borate, sodium metasilicate and disodium dihydrogen phosphate. Kepfer, in effect, teaches exceptions to the general rule set forth by Johnson. It has been found that Johnson was wrong, at least in one respect, as detailed hereinafter.

It can thus be seen that pyrophosphate has the potential of being a much more effective detergency builder than do the tripolyphosphate salts.

It has now been discovered that alkali metal pyrophosphates can be formulated into a detergent composition in a manner such that the pyrophosphate builds by first associating with one mole of calcium and then precipitating up to two moles of calcium per moles of pyrophosphate. An advantage to the precipitation of pyrophosphate in large amounts is that the precipitate can be removed from waste water and used as a fertilizer in the sewerage sludge.

It is thus an object of the present invention to more efficiently utilize alkali metal pyrophosphates as detergent builders.

It is a further object of the present invention to provide a reduced phosphorus content detergent product without substantially impairing cleaning in hard water.

It is yet another object of the present invention to utilize metal pyrophosphate salt in such a manner that it precipitates as the dicalcium salt thereof.

It is yet a further object of the present invention to provide greater cleaning due to increased hardness control in a product of limited phosphate content.

It is yet a further object of the present invention to diminish the deposition of water hardness salts upon fabrics in the wash solution.

These, and other objects which will become apparent, are to be achieved by processing the alkali metal pyrophosphate and the detergent with a high ratio alkali metal silicate such that substantially all of the moisture is removed from the resultant product.

Percentages and ratios given throughout the application are by weight unless otherwise indicated. Temperatures are in degress Fahrenheit unless otherwise noted. The term dry weight basis indicates that the slurry when dried would have the same weight percentages in a finished product.

SUMMARY OF THE INVENTION

The present invention relates to an alkaline solid granular detergent composition consisting essentially of:

1. from about 20 to 100% by weight of a detergent material in the form of homogeneous granules containing;
   a. from about 1 to about 30% by weight of a silicate having the formula $SiO_2:M_2O$ wherein M is sodium or potassium or mixtures thereof and the molar ratio of $SiO_2:M_2O$ is from about 1.6:1 to 4:1, said silicate being characterized in that when 1.2 grams of the alkaline solid granular detergent composition are added to 1 liter of distilled water at 25° C, agitated for one minute to avoid lumping, and filtered through a 142 mm diameter, five micron pore size filter under nitrogen at 6.8 atmospheres pressure that the molar ratio of the filtrate $SiO_2$ to the total $SiO_2$ from the silicate in the complete alkaline detergent composition is no more than about 3.3:4;
   b. from 0 to about 60% by weight of pyrophosphate having the formula $M_xH_y(P_2O_7)$ wherein the sum of $x$ and $y$ is 4 and M is sodium or potassium or mixtures thereof;
   c. from 0 to about 80% by weight of diluent; and
   d. from about 1 to about 50% by weight of an anionic, nonionic, zwitterionic, or ampholytic detergent and mixtures thereof; and
2. from 0 to about 60% by weight of an alkaline sodium or potassium pyrophosphate or mixtures thereof, to give a detergent composition containing from about 5% to about 60% by weight of said pyrophosphate; and
3. from 0 to about 80% by weight of a diluent; the total amount of alkali metal tripolyphosphate present being less than about 20% by weight of the total pyrophosphate present.

Preferably, the said homogeneous granular detergent material (1) is formed by spray drying a slurry of the components.

The invention relates more specifically to an alkaline solid detergent composition consisting essentially of:

1. from about 20 to 100% of a homogeneous detergent material containing;
   a. from about 1 to about 30% by weight of a silicate having the formula $SiO_2:M_2O$ wherein M is sodium or potassium or mixtures thereof and the molar ratio of $SiO_2:M_2O$ is from about 1.6:1 to 4:1,
   b. from 0 to about 60% by weight of a pyrophosphate having the formula $M_xH_y(P_2O_7)$ wherein the sum of $x$ and $y$ is 4 and M is sodium or potassium or mixtures thereof;
   c. from 0 to about 80% by weight of diluent; and
   d. from about 1 to about 50% by weight of an anionic, nonionic, zwitterionic, or ampholytic detergent and mixtures thereof; and
2. from 0 to about 60% by weight of an alkaline sodium or potassium pyrophosphate or mixtures thereof, to give a detergent composition containing from about 5 to about 60% of said pyrophosphate; and
3. from about 0 to about 80% by weight of a diluent; said detergent (1) being dried to an $SiO_2:H_2O$ molar ratio of greater than about 0.5, and the total amount of alkali metal tripolyphosphate present being less than about 20% by weight of the total pyrophosphate present.

The invention still more specifically relates to a detergent composition prepared by the process of:

1. forming an aqueous slurry comprising
   a. from about 1 to about 25% on a dry weight basis of an alkali metal silicate having the formula $SiO_2:M_2O$, wherein the $SiO_2:M_2O$ weight ratio is from about 1.6:1 to about 4:1, and M is an alkali metal or mixtures thereof;
   b. from about 0 to about 60% on a dry weight basis of an alkali metal pyrophosphate having the formula $M_xH_y(P_2O_7)$ and the sum of $x + y$ are integers equal to 4; M is an alkali metal or mixtures thereof;
   c. from about 0.1% to about 80% on a dry weight basis of a diluent;
   d. from about 1 to about 50% on a dry weight basis of an anionic, nonionic, zwitterionic, or ampholytic detergent and mixtures thereof; then,
2. drying the slurry of (1) to a moisture content not exceeding about 5% by weight; and,
3, admixing from about 0 to about 60% on a dry weight basis of the material described in (1) (b) to give a detergent composition containing from about 5 to about 60% by weight $M_4(P_2O_7)$ wherein M is an alkali metal.

The process for forming the compositions are also within the scope of the invention.

DETAILED DESCRIPTION OF THE INVENTION

The pyrophosphate salts of the finished product in the present invention have alkali metal cations, such as sodium or potassium, preferably sodium. Pyrophosphate salts useful herein may be obtained commercially by neutralization of the corresponding pyrophosphoric acid salt. Preferably the pyrophosphate is substantially free of tripolyphosphate, however, up to about 20%, preferably less than 10% and most preferably less than 5%, of tripolyphosphates may be present by weight of the pyrophosphate. Tripolyposphates tend to inhibit the precipitation reaction in which dicalcium pyrophosophate is formed and thereby diminish the performance of the composition at high hardness levels. Preferably, the compositions are substantially free of orthophosphates, i.e., no more than 5% or orthophosphate by weight of the pyrophosphate. Similarly, if tripolyphosphate salts are dried with the pyrophosphate the temperature conditions necessary to achieve the moisture content of the finished produce will cause reversion of the tripolyphosphate, producing some undesired orthophosphate. The pyrophosphate salts under the conditions expressed in the present invention do not substantially degrade into the orthophosphate salts upon drying. The pyrophosphates of the present invention may be either anhydrous or hydrated forms; preferably the former in a finely divided form a permit rapid dissolution in the wash.

The alkali metal pyrophosphate is typically added to the slurry, or formed in situ in the slurry by neutralization and dried, or added to the product of the dried slurry. The pyrophosphate acid salts are not effective builders and thus the finished product must contain from about 5 to about 60%, ordinarily about 9 to about 50%, preferably about 12 to about 45%, and most preferably about 17 to about 35% on a dry weight basis of the alkali metal pyrophosphate. If the acid pyrophosphates are employed the product should contain a source of alkalinity preferably by using sodium carbonate as the diluent. Where none or not all of the alkali metal pyrophosphate is included in the slurry, additional amounts up to the total in the finished product are admixed with the dried product of the slurry.

The second component of the detergent composition of the present invention is an alkali metal silicate having the formula $SiO_1:M_2O$ wherein M is an alkali metal or mixtures thereof, such as the sodium or potassium salt, preferably sodium. The molar ratio $SiO_2:M_2O$ is from about 1.6:1 to about 4:1, ordinarily about 2:1 to about 4:1, preferably from about 2.4:1 to about 4:1, and most preferably from about 2.75:1 to about 4:1. For the product by process compostions the $SiO_2:M_2O$ ratios are by weight.

The alkali metal silicate is typically present in the slurry used to form the homogeneous composition at from about 1 to about 30%, preferably from about 1 to about 25%, more preferably about 2 to about 20%, and most preferably about 4 to about 15% on a dry weight basis.

The benefits of the invention are most clearly demonstrated when the weight ratio of the alkali metal silicate to the alkali metal pyrophosphate in the finished product is from about 1:60 to about 5:1, preferably from about 1:30 to about 4:1, and most preferably from about 1:15 to about 2:1.

Contrary to the teachings of the prior art, it has been found that improved performance is obtained if the pyrophosphate dissolves in the wash solution first. It has been found surprisingly, that when the silicate described above is dried to a moisture level wherein the $SiO_2:H_2O$ molar ratio in the homogeneous composition is greater than about 0.5, preferably greater than about 0.6, more preferably greater than about 0.8 and most preferably greater than about 1.0, the silicate is converted into a less quickly soluble species which is believed to be a dehydrated polymer. When rehydrated, the polymer is broken down into a more readily soluble species. However, this regeneration occurs sufficiently slowly when the composition is added to water to form an aqueous wash solution so that the pyrophosphate is able to provide control of the hardness, e.g. calcium ions by precipitation before too much of the readily soluble interfering species of silicate is reformed. The formation of the polymeric silicate occurs when the products are dried to at most a 5% by weight moisture content. Lower moisture levels are desirable when lower ratio silicates are utilized.

A measure of the degree of polymerization of the silicate is obtained by dissolving or leaching the composition in distilled water (1.2 grams/liter at 25° C) and after agitating the sample for one minute, filtering the solution through a 142 mm, 5 micron Millipore filter in less than about five seconds normally about three seconds, at 6.8 atmospheres of nitrogen pressure. The filtrate is then analyzed for $SiO_2$ by any of the following methods herein incorporated by reference.

1. Hargis, L. G. Anal. Chem. 42. 1494 (1970)
2. Hargis, L. G., Anal. Chem. Acta, 52, 1 (1970)
3. Babulak, S. W. and Gildenberg L. J., Am. Oil Chem. Soc., 50, 296 (1973)
4. Chalmers, R. A. and Silclair, A. G., Anal. Chem. Acta, 34, 412 (1966)
5. Mivelay, W. F., Advances in Automated Analysis, Technicon International Congress, II, 361 (1970)

It has been found that a molar ratio of the filtrate $SiO_2$ found in this solution to the pyrophosphate in the composition of less that about 0.9:1 indicates that the silicate will not interfere with pyrophosphate precipitation whereas a ratio of 5:1 will indicate that the silicate will interfere with the precipitation. A ratio of equal to or less than about 0.9:1 is preferred, more preferably less than 0.7:1 and most preferably less than 0.5:1. The method of formation of the polymer is irrelevant.

In forming the dehydrated polymer, the molar ratio of the filtrate $SiO_2$ to the total $SiO_2$ from the sodium or potassium silicate in the composition by the above described test is less than 3.3:4, preferably less than 3:4, more preferably less than 1.3:2, and most preferably less than 1:2.

Avoidance of rehydration of protection from moisture is desirable. For example, protective packaging, moisture sinks, and minimization of surface by use of large particle sizes and coatings are all desirable. However, normally the product loses only a small fraction of its effectiveness upon storage.

The slurry to be dried additionally contains a diluent in an amount from 0 to about 80%, preferably from about 0.1 to about 80%, more preferably from about 1 to about 55%, and most preferably from about 2 to about 45% on a dry weight basis. In formulating the present invention it has been found most desirable to prepare a slurry to be dried with the alkali metal pyrophosphate, the detergent and silicate all present. It has been found, however, that none of the alkali metal pyrophosphate need be in the dried granule to give adequate performance. The diluent is normally required to give desirable characteristics to the dried product of the slurry especially when the product is formed by spray drying as later described. Where no diluent is used the granules tend to be sticky and not flow freely.

The diluent materials useful in the present invention are primarily but not necessarily inert in the slurry or the composition. They are preferably inorganic. For instance a preferred diluent is sodium carbonate which provides alkalinity to the composition thus favoring detergency. The sodium carbonate will also neutralize the acid pyrophosphates present in the slurry or admixed in dried product thereby rendering the latter a more effective builder. Additonally sodium carbonate will control water hardness to a certain extent. On the other hand sodium sulfate, also a preferred diluent, serves only to provide desirable granule characteristics.

The diluents which are suitable alone or in mixtures in the present invention include natural and synthetic clays, such as montmorillonite, hectorite, saponite, volchonskoite non-tronic, and sauconite; alkali metal carbonates, especially sodium and potassium, and salts or bicarbonates, sesquicarbonates, borates, perborates, sulfates, chlorides, bisulfates, and aluminates. Also useful as a diluent in the slurry is calcium carbonate.

The lower limit on the water in the aqueous slurry to be dried is determined by the amount which is sufficient to allow the detergent and the silicate with the diluent and/or pyrophosphate to become thoroughly mixed prior to the drying step. The upper limit of water in the slurry is effectively determined by the economics of not having to drive off any more water than is necessary to achieve the dried product of the requisite moisture content. Generally, the amount of water in the aqueous slurry should be from about 20 to about 95%, preferably from about 25 to about 75%, and most preferably from about 30 to about 50% by weight of the total composition of the slurry.

Detergent Component

It is believed that the surfacant (detergent) should be in intimate association with the silicate. This can be conveniently arranged by drying a slurry containing both the silicate and the surfactant so that the portion of the composition containing these two ingredients is essentially homogeneous. This is desirable also since the silicate makes the granule crisp and free-flowing.

When formulating a detergent composition in accordance with the present invention, any anionic, nonionic, zwitterionic or ampholytic detergent may be employed. Anionic detergents are preferred since they interfere least with the pyrophosphate precipitation reaction. The following detergents are exemplary of those which may be used in the present invention.

Preferably the detergent component of the present invention is a water-soluble salt of: an ethoxylated sulfated alcohol with an average degree of ethoxylation of about 1 to 4 and an alkyl chain length of about 14 to 16; tallow ethoxy sulfate; tallow alcohol sulfates; an alkyl benzene sulfonate with an average alkyl chain length between 11 and 13, preferably 11.2 carbon atoms; a $C_6$–$C_{20}$ $\alpha$-sulfocarboxylic acid or ester thereof having 1 to 14 carbon atoms in the alcohol radical; a $C_8$–$C_{24}$ paraffin sulfonate; a $C_{10}$–$C_{24}$ $\alpha$-olefin sulfonate or mixtures thereof; or other anionic sulfur-containing surfactant. Such preferred detergents are discussed below.

An especially preferred alkyl ether sulfate detergent component of the present invention is a mixture of alkyl ether sulfates, said mixing having an average (arithmetic mean) carbon chain length within the range of about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide.

Specifically, such preferred mixtures comprise from about 0 to 10% by weight of mixture of $C_{12\text{-}13}$ compounds, from about 0 to 100% by weight of mixture of $C_{14\text{-}15}$ compounds, and from about 0 to 45% by weight of mixture of $C_{16\text{-}17}$ compounds, and from about 0 to 10% by weight of a mixture of $C_{18\text{-}19}$ compounds. Further, such preferred alkyl ether sulfate mixtures comprise from about 0 to 30% by weight of mixture of compounds having a degree of ethoxylation of 0, from about 45 to 95% by weight of mixture of compounds having a degree of ethoxylation from 1 to 4, from about 5 to 25% by weight of mixture of compounds having a degree of ethoxylation from 5 to 8, and from about 0 to 15% by weight of mixture of compounds having a degree of ethoxylation greater than 8. The sulfated condensation products of ethoxylated alcohols of 8 to 24 alkyl carbons and with from 1 to 30, preferably 1 to 4 moles of ethylene oxide may be used in place of the preferred alkyl ether sulfates discussed above.

Another class of detergents which may be used in the present invention includes the water-soluble salts, particularly the alkali metal, ammonium, and alkylolammonium salts of organic sulfuric reaction products having in their molecular structure an alkyl group containing from about 8 to about 22 carbon atoms and a sulfuric acid ester group. Examples of this group of synthetic detergents are the sodium and potassium alkyl sulfates, especially those obtained by sulfating the higher alcohols ($C_8$–$C_{18}$ carbon atoms) produced by reducing the glycerides of tallow or coconut oil.

Preferred water-soluble organic detergent compounds herein include alkyl benzene sulfonates (preferably essentially linear although "hard" ABS may be used) containing from about 9 to 15 carbon atoms in the alkyl group. Examples of the above are sodium and potassium alkyl benzene sulfonates in which the alkyl group contains from about 11 to about 13 carbon atoms, in straight chain or branched chain configuration, e.g., those of the type described in U.S. Pat. Nos. 2,220,099 and 2,477,383. Especially valuable are straight chain alkyl benzene sulfonates in which the average of the alkyl groups is about 11.2 carbon atoms, abbreviated as $C_{11.2}$LAS.

Another useful detergent compound herein includes the water-soluble salts of esters of $\alpha$-sulfonated fatty acids containing from about 6 to 20 carbon atoms in the fatty acid group and their esters from about 1 to 14 carbon atoms in the alcohol radical.

Preferred "olefin sulfonate" detergent mixtures utilizable herein comprise olefin sulfonates containing from about 10 to about 24 carbon atoms. Such materials can be produced by sulfonation of $\alpha$-olefins by means of uncomplexed sulfur trioxide followed by neutralization under conditions such that any sultones present are hydrolyzed to the corresponding hydroxyalkane sulfonates. The $\alpha$-olefin starting materials preferably have from 14 to 16 carbon atoms. Said preferred $\alpha$-olefin sulfonates are described in U.S. Pat. No. 3,332,880, incorporated herein by reference.

The paraffin sulfonates embraced in the present invention are essentially linear and contain from 8 to 24 carbon atoms, preferably 12 to 20 and more preferably 14 to 18 carbon atoms in the alkyl radical.

Other anionic detergent compounds herein include the sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble salts of the higher fatty acids, i.e. "soaps", are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name "Pluronic" sold by Wyandotte Chemicals. These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g. the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g. a coconut alcohol-ethylene oxide condensate having from 5 to 30 moles of ethylene oxide per mole of coconut alcohol fraction having from 10 to 14 carbon atoms, are also useful nonionic detergents herein. Additional nonionics useful herein include those listed in U.S. Pat. application Ser. No. 453,464 to Collins filed Mar. 21, 1974 now abandoned and in U.S. Pat. application Ser. No. 570,940 filed Apr. 22, 1975 now abandoned entitled DETERGENT COMPOSITION to LaGasse et al incorporated by reference.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group. Further use of zwitterionic detergents are discussed in U.S. Pat. applications Ser. Nos. 493,952 and 493,953 to Laughlin et al filed Aug. 1, 1974 incorporated by reference now U.S. Pat. Nos. 3,925,262 issued Dec. 9, 1975 and 3,929,678 issued Dec. 30, 1975, respectively.

Other useful detergents include water-soluble salts of 2-acyloxy-alkane-1-sulfonic acids containing from about 2 to 9 carbon atoms in the acyl group and from about 9 to about 23 carbon atoms in the alkane moiety; β-alkyloxy alkane sulfonates containing from about 1 to 3 carbon atoms in the alkyl group and from about 8 to 20 carbon atoms in the alkane moiety, alkyl dimethyl amine oxides wherein the alkyl group contains from about 11 to 16 carbon atoms; alkyl-dimethyl-ammonio-propane-sulfonates and alkyl-dimethyl-ammonio-hydroxy-propane-sulfonates wherein the alkyl group in both types contains from about 14 to 18 carbon atoms; soaps as hereinabove defined; the condensation product of tallow fatty alcohol with about 11 moles of ethylene oxide; the condensation product of a $C_{13}$ (avg.) secondary alcohol with 9 moles of ethylene oxide; and alkyl glyceral ether sulfates with from 10 to 18 carbon atoms in the alkyl radical.

A typical listing of the classes and species of detergent compounds useful herein appear in U.S. Pat. No. 3,852,211 to Ohren issued Dec. 3, 1974, incorporated herein by reference. The foregoing list of detergent compounds and mixtures which can be used in the instant compositions is representative of such materials, but is not intended to be limiting.

A particularly useful anionic detergent mixture comprises:

i. from about 2 to about 15% by weight of an alkyl sulfate wherein the alkyl radical has from 10 to 20 carbon atoms and mixtures thereof the cation being an alkali metal preferably sodium;

ii. from about 2 to about 15% by weight of an alkyl benzene sulfonate having from 9 to 15 carbon atoms in the alkyl radical and mixtures thereof the cation being an alkali metal preferably sodium.

An additional component which may be added to (i) and (ii) above is:

iii. from about 2 to about 15% by weight of an alkyl ethoxy sulfate having from 10 to 20 carbon atoms in the alkyl radical and from 1 to 30 ethoxy groups and mixtures thereof having an alkali metal preferably sodium cation.

The detergent is present in the aqueous slurry typically used to prepare the compositions of this invention at levels of about 1 to 50%, preferably from about 5 to about 40%, and most preferably from about 10 to about 30% on a dry weight basis.

ADDITIONAL COMPONENTS

It is to be understood that the compositions of the present invention may be supplemented by all manner of detergent components, either by including such components in the aqueous slurry to be dried or by admixing such components with the composition of the invention following the drying step. Soil suspending agents at about 0.1 to 10% by weight such as water-soluble salts of carboxymethylcellulose, carboxyhydroxymethylcellulose copolymers of vinyl ether and maleic anhydride and preferably polyethylene glycols having a molecular weight of about 400 to 10,000 are common components of the present invention. Dyes, pigments, optical brighteners, and perfumes can be added in varying amounts as desired. Suitable bleaches herein include percarbonates, perborates, and activators therefor.

Additional components which are desirable in the present invention are the whiteness maintenance additives. In particular glassy phosphates at levels of from about 0.1 to 4% having the formula $$(M_2O)_x(P_2O_5)_y$$

wherein M is an alkali metal, preferably sodium; $y$ having a value of from about 5 to 50, preferably 7 to 25 with the ratio of $y$:$x$ from about 1:1 to about 1:1.5 are useful in the present invention for whiteness maintenance.

Preferred values of $y$ above are such that there are 10, 14, and 21, most preferably 14 and 21 phosphorous atoms in the compound. A more preferred range of glassy phosphate is from about 0.5 to about 2.5% by weight, most preferably from about 1.0 to about 2% by weight of the finished product. Alternatively the formula of the glassy phosphates can be expressed as $M_{(2y+2)}P_y O_{(6y+1)}$ wherein M is an alkali metal and $y$ varies from 7 to 12.

Other materials such as fluorescers, antiseptics, germicides, enzymes in minor amounts, anti-caking agents such as sodium sulfosuccinate, and sodium benzoate may also be added. Enzymes suitable for use herein include those discussed in U.S. Pat. Nos. 3,519,570 and 3,553,139 to McCarty and McCarty et al issued July 7, 1970 and Jan. 5, 1971, respectively, incorporated by reference.

Additional amounts of water-soluble detergency builders may be added to the detergent compositions of the present invention. Such inorgaic detergency builder salts include alkali metal carbonates, borates, and bicarbonates. Specific examples of such salts are the sodium and potassium borates, perborates, bicarbonates, and carbonates.

Examples of suitable organic detergency builder salts are: (1) water-soluble aminopolycarboxylates, e.g. sodium and potassium ethylenediaminetetraacetates, nitrilotriacetates and N-(2-hydroxyethyl)-nitrilodiacetates; (2) water-soluble salts of phytic acid, e.g. sodium and potassium phytates — see U.S. Pat. No. 2,739,942; (3) water-soluble polyphosphonates, including specifically, sodium, potassium and lithium salts of ethane-1-hydroxy-1,1-diphosphonic acid, sodium, potassium and lithium salts of methylene diphosphonic acid, sodium, potassium and lithium salts of ethylene diphosphonic acid, and sodium, potassium and lithium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphoric acid, propane-1,1,3,3-tetraphosphonic acid, propane-1,1,2,3-tetraphosphonic acid, and propane-1,2,2,3-tetraphosphonic acid; and (4water-soluble salts of polycarboxylate polymers and copolymers as described in U.S. Pat. No. 3,308,067.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

In addition, other builders which can be used satisfactorily include water-soluble salts of mellitic acid, citric acid, pyromellitic acid, benzene pentacarboxylic acid, oxydiacetic acid, carboxymethyloxysuccinic acid, and oxydisuccinic acid.

The detergent compositions of this invention preferably contain the water-soluble detergent in a ratio to the total builder present in a weight ratio of from about 10:1 to about 1:10, preferably from about 3:1 to about 1:3. The amount of additional builder in the detergent compositions of the present invention is from about 5 to about 50%, preferably from about 10 to about 25%. These additional builders may be dried with the aqueous slurry or admixed with the dried product of the slurry. If desired the additional builder can be the diluent material and thereby added to the slurry to be dried.

Certain zeolites or alumino silicates when dried with the components of the slurry enhance the function of the silicate of the slurry and add building capacity in that the alumino slicates sequester calcium hardness. When admixed with the dried product of the slurry the alumino silicates function as a cobuilder to the pyrophosates. One such alumino silicate which is useful in the compositions of the invention is an amorphous water-insoluble hydrated compound of the formula $Na_x(xAlO_2.ySiO_2)$, wherein $x$ is an integer of from 1 to 1.2 and $y$ is 1, said amorphous material being further characterized by a $Mg^{++}$ exchange capacity of from about 50 mg. eg. $CaCO_3$/g. This magnesium exchange capacity is equivalent to a range of from about 1 to about 3 meq./g. to about 150 mg eq. $CaCO_3$/g. This ion exchange builder is more fully described in Ireland published patent application 1505/74, to B. H. Gedge et al filed July 16, 1974, herein incorporated by reference.

A second water-insoluble synthetic aluminosilicate ion exchange material useful herein has the formula $Na_z[(AlO_2)_z.(SiO_2)_y]xH_2O$, wherein $z$ and $y$ are integers of at least 6; the molar ratio of $z$ to $y$ is in the range from 1.0 to about 0.5, and $x$ is an integer from about 15 to about 264; said aluminosilicate ion exchange material having a particle size diameter from about 0.1 micron to about 100 microns; a calcium ion exchange capacity of at least about 200 mg eq./g; and a calcium ion exchange rate of at least about 2 grains/gallon/minute gram as described in Belgian Pat. No. 814,874 herein incorporated by reference. This corresponds to a calcium ion exchange capacity of at least about 4 meq./g.

The above-described aluminosilicates are employed at levels of from about 1 to about 40%, preferably about 5 to about 25% by weight.

COMPOSITION PREPARATION

The detergent compositions of the present invention is prepared by a process for forming a detergent composition comprising the steps of:

1. forming an aqueous slurry comprising
   a. from about 1 to about 30% on a dry weight basis of an alkali metal silicate having the formula $SiO_2:M_2O$, wherein the $SiO_2:M_2O$ weight ratio is from about 1.6:1 to about 4:1, and M is an alkali metal or mixtures thereof;
   b. from about 0 to about 60% on a dry weight basis of an alkali metal pyrophosphate haing the formula $M_xH_y(P_2O_7)$ and the sum of $x + y$ are integers equal to 4; M is an alkali metal or mixtures thereof;
   c. from 0 to about 80% on a dry weight basis of a diluent;
   d. from about 1 to about 50% on a dry weight basis of an anionic, nonionic, zwitterionic, or ampholytic detergent and mixtures thereof; then
2. drying the slurry of (1) to an $SiO_2:H_2O$ molar ratio of greater than about 0.5; and
3. admixing from about 0 to about 60% on a dry weight basis of the material described in (1) (*b*) to give a detergent composition containing from about 5 to about 60% by weight $M_4(P_2O_7)$ wherein M is an alkali metal, the amount of tripolyphosphate in said composition being less than 20% by weight of the amount of pyrophosphate.

Preferably they are prepared by a process for preparing a detergent composition comprising the steps of:

1. forming an aqueous slurry comprising
   a. from about 1 to about 25% on a dry weight basis of an alkali metal silicate having the formula $SiO_2:M_2O$, wherein the $SiO_2:M_2O$ weight ratio is from about 1.6:1 to about 4:1, and M is an alkali metal or mixtures thereof;
   b. from about 0 to about 60% on a dry weight basis of an alkali metal pyrophosphate having the formula $M_xH_y(P_2O_7)$ and the sum of $x + y$ are integers equal to 4; M is an alkali metal or mixtures thereof;
   c. from about 0.1 to about 80% on a dry weight basis of a diluent;
   d. from about 1 to about 50% on a dry weight basis of an anionic, nonionic, zwitterionic, or ampholytic detergent and mixtures thereof; then
2. drying the slurry of (1) to a moisture content not exceeding about 5% by weight; and
3. admixing from about 0 to about 60% on a dry weight basis of the material described in (1) (*b*) to give a detergent composition containing from about 5 to about 60% by weight $M_4(P_2O_7)$ wherein M is an alkali metal.

Preferably, the moisture content of the product immediately following the drying operation will contain moisture at a level of from about 0.1 to about 3.5%, more preferably from about 0.4 to about 3% and most preferably from about 1.5 to about 2.5% by weight of the total solids present in the composition.

The product may partially rehydrate to higher moisture levels. However, the amount of rehydration is normally not enough to cause substantial performance loss.

The lower limit on the moisture content of the detergent composition of the present invention will be determined partly by the economics involved in that the more the granule is dried the more costly the drying operation and that charring may result from the oxidation of the organic components if the drying temperature is too high.

The moisture content of the dried product may be determined by any convenient method. One such method is to weigh a sample of the product following the drying step and to then heat the product at a substantially higher temperature than that employed in the drying operation and determining the amount of moisture which is driven off in the second heating step. This figure is thus expressed as a percentage of the total solids present.

The detergent compositions of the present invention can be prepared by drying the slurry to a solid product of the requisite moisture content by any convenient means. Preferably, the drying to a solid is carried out as a single operation in spray-drying towers such as those described in U.S. Pat. Nos. 3,629,451 and 3,629,955, both of which were issued to Robert P. Davis et al, Dec. 28, 1971, both of which are incorporated herein by reference. Other methods of drying the compositions of the present invention include freeze drying, drum drying, and oven drying. The product may also be formed in a series of steps, such as by agglomeration as described in U.S. Pat. NO. 2,895,916 herein incorporated by reference followed by drying the agglomerated product.

Preferably the preparation of the detergent composition comprises the steps of adding the alkali metal silicate, the detergent, the pyrophosphate and diluent as well as other compatible ingredients, to an aqueous slurry and thoroughly mixing (crutching) the composition. The thoroughly mixed slurry is then dried such as by the previously mentioned spray-drying operation. The slurry temperature may vary according to the solubility of the components. It kept above about 180° F the pyrophosphate, if present in the slurry, will be anhydrous when dried. Where freeze drying is used it may be necessary to further dry product down to the requisite moisture content by additional steps such as oven drying. The product of the present invention is desirably in granular form. Thus if the product is formed in large irregular chunks it is ground to form the desired size granules. The products may be formed into detergent bars as described in U.S. Pat. No. 3,178,370 issued Apr. 13, 1965 and British Pat. No. 1,064,414 issued Apr. 5, 1967 both to Okenfuss herein incorporated by reference.

Granular products in the present invention are preferably prepared by spray drying. The spray-drying operation can be carried out in countercurrent or cocurrent drying towers, preferably in countercurrent towers. In its simplest aspect the products of the present invention are spray dried by pumping the slurry which has been crutched to the spray-drying tower where the slurry is fed through a series of atomizing nozzles in a direction opposite to the flow of the hot drying gases. The temperature of the hot air mixture should be in the range of from about 150° to about 1500° F, preferably from about 200° to about 1000° F, and most preferably from about 220° to about 700° F.

The temperature range within which the granules of the present invention reach is from about 120° to about 300° F, preferably from about 140° to about 275° F, and most preferably from about 150° to about 250° F.

When a multilevel spray-drying apparatus is employed such as described in the Davis et al patent, previously incorporated herein by reference, the product is suitably spray dried with the remaining conditions listed therein.

The detergent composition prepared in accordance with the present invention is preferably used in solid form product, preferably a granule.

The compositions of the present invention are preferably used at concentrations of from about 0.05 to about 1.5% by weight. Wash temperatures range from 50° to 130° F however, under European conditions the product is often used at about 200° F and at higher concentrations than those listed.

The following are Examples of the present invention.

EXAMPLE I

Spray-dried products are formulated in A and B below:

| A | | B |
|---|---|---|
| 9.9% | sodium tallow alcohol sulfate | 9.2% |
| 8.1 | sodium alkyl (11.8 average) benzene sulfonate* | 7.6 |
| 10.1 | sodium silicate ($SiO_2$:$Na_2O$ 3.2:1) | — |
| — | sodium silicate ($SiO_2$:$Na_2O$ 1.6:1) | 5.9 |
| 26.2 | sodium pyrophosphate | — |
| — | sodium tripolyphosphate | 49.4 |
| 0.8 | moisture | 10.0 |
| 42.0 | sodium sulfate | 14.2 |
| | minors** to 100% | |

*Sodium alkyl (11.8 average) benzene sulfonate indicates that the average chain length to the alkyl portion of the molecule was 11.8 carbon atoms.
**Minors include for example brighteners, perfumes, bleaches, and soil antiredeposition agents such as those previously discussed.

Composition A is made in accordance with the present invention with all components spray dried to the listed moisture content. Composition B is spray dried to the listed moisture content with all components in the slurry. Performance of the products is measured by a Hunter-Whiteness meter as Hunter Whiteness Units (HWU hereafter) on Dacron Polyester fabrics soiled with clay. The fabrics are washed in 100° F water at a product level of 0.12% by weight in the wash.

| Hardness | A(HWU) | B(HWU) |
|---|---|---|
| 9 grains (3:1/ $Ca^{++}$:$Mg^{++}$ | 35.6 | 34.3 |
| 11 grains (3:1/ $Ca^{++}$:$Mg^{++}$ | 22.6 | 24.2 |
| Least Significant Difference $LSD_{0.05}$ = 2.0 | | |

This test shows composition A of the present invention performing equivalently on clay soil removal to a product (B) containing substantially more phosphate.

The moisture content of the detergent product is determined by boiling distillation. The boiling distillation or B.D. method is carried out by placing a 25 gram sample of the dried detergent product into a 500 ml. round bottomed flask. The detergent product in the round bottomed flask is then covered with 250 ml. of toluene. Instead of toluene any inert distillation fluid such as kerosene or xylene may be used. The round bottomed flask is then heated from 190° to 200° C and the vapors emitted are refluxed through a water cooled condenser which is sealed from the atmosphere. The volatile materials which are evaporated are collected in a graduated side arm of the condenser. The distillation process is carried out until no further change is observed in the aqueous layer of the distillate. The amount of moisture is determined by converting the volume of water collected in the distillation flask to a given weight of moisture by an appropriate density factor. If volatile materials are present in the composition which are miscible in the aqueous layer of the distillate the Karl Fischer method of moisture determination may be used to accurately determine the moisture content. Composition A has an $SiO_2$:$H_2O$ molar ratio of 2.88.

EXAMPLE II

The following products are prepared (C and D):

| C | | D |
|---|---|---|
| 5.5% | sodium tallow alcohol sulfate | 5.5% |
| 7.0 | sodium alkyl (11.8 average) benzene sulfonate | 7.0 |
| 5.5 | sodium alkyl ($C_{14}$–$C_{16}$)* triethoxy sulfate | 5.5 |
| 10.1 | sodium silicate ($SiO_2$:$Na_2O$ 3.2:1) | 10.1 |
| 42.0 | sodium sulfate | 42.0 |
| 1.0 | moisture | 1.0 |
| 26.2 | sodium pyrophosphate | — |
| — | sodium tripolyphosphate minors to 100% | 24.4 |

*A mixture of alkyl ethoxy sulfates wherein the alkyl chain varies between 14 and 16 carbon atoms and the ethoxylate distribution averages 3 moles of ethylene oxide per mole of alcohol.

All of the ingredients except the polymeric phosphate are spray dried to the moisture listed and the polyphosphates as granules are admixed to give a phosphorous content in each composition of 6.1%.

Compositions C and D are used as Example I at the same temperature, concentration, hardness ratios and on Dacron Polyester swatches soiled with clay.

The results of washing are:

| Hardness | C(HWU) | D(HWU) |
|---|---|---|
| 9 grains | 39.3 | 5.7 |
| 11 grains | 24.5 | 4.8 |
| $LSD_{0.05}$ = 2.3 | | |

Example II shows equal phosphorus contents for C and D but with superior performance for pyrophosphate (C) over tripolyphosphate (D). Composition C has an $SiO_2$:$H_2O$ molar ratio of 2.3.

EXAMPLE III

Compositions E and F are prepared by spray drying all the components:

| E | | F |
|---|---|---|
| 5.5% | sodium tallow alcohol sulfate | 5.5% |
| 7.0 | sodium alkyl ($C_{11.8}$) benzene sulfonate | 7.0 |
| 5.5 | sodium ($C_{14}$–$C_{16}$) triethoxy sulfate | 5.5 |
| 40.0 | sodium sulfate | 37.0 |
| 12.0 | sodium silicate ($SiO_2$:$Na_2O$ 2.4:1) | 12.0 |

-continued

| | | |
|---|---|---|
| 26.2 | sodium pyrophosphate | — |
| — | sodium tripolyphosphate | 24.4 |
| 2.5 | moisture | 6.0 |
| | minors to 100% | |

The products are tested as in Examples I and II with the following results:

| Hardness | E(HWU) | F(HWU) |
|---|---|---|
| 9 grains | 33 | 12 |
| 11 grains | 23 | 12 |
| $LSD_{0.05} = 1.9$ | | |

The product prepared by the present invention (E) shows that silicate ratio is lowered without substantial performance loss relative to C of Example II and F with all products at equal phosphorus contents (6.1%) and dried to the respective moisture contents.

EXAMPLE IV

Products G, H, and J are prepared by spray drying all the components. Products G and H are identical to product A in Example I except that G is dried to 1.7% moisture and H is only dried to 5.5% moisture. Product J is identical to Product B* in Example I.

* Product B in Example I at 9 grains gave 34.3 HWU whereas Product J above is 25.8 HWU at 9 grains the difference arises in the amount of clay used and differences in the bolts from which the swatches were cut.

Products G, H, and J are tested by washing Dacron Polyester fabric swatches at 100° F at product levels of 0.12% by weight of the wash solution. The fabrics have been soiled with clay and the wash water contains 9 grains per gallon hardness with $Ca^{++}$:$Mg^{++}$ at 3.1. The results are:

| G(HWU) | H(HWU) | J(HWU) |
|---|---|---|
| 21.6 | 10.8 | 25.8 |
| $LSD_{0.05} = 1.8$ | | |

Product G prepared by the present invention performs significantly better than Product H where the moisture content is higher. Product G having a much lower phosphorus content than Product J performs similar to Product J. In Example I where Product A (G here) performed better but with in the $LSD_{0.05}$ limits than Product B (J here) the moisture content of Product A was less than Product G (0.8 versus 1.7% respectively. Products G and H have $SiO_2$:$H_2O$ molar ratios of 1.27 and 0.39 respectively. The approximate molar ratio of the filtrate silicate to the total pyrophosphate in the alkaline product are 0.36 and 1.0 respectively for Products G and H while the approximate molar ratio of the filtrate $SiO_2$ to the total $SiO_2$ from the sodium silicate are 0.56:2 and 3.4:4 respectively.

EXAMPLE V

Products K, L, and M were prepared by spray drying the following compositions:

| | K | L | M |
|---|---|---|---|
| sodium tallow alcohol sulfate | 9.9% | 9.9% | 9.9% |
| sodium alkyl (11.8 average) benzene sulfonate | 8.1 | 8.1 | 8.1 |
| sodium pyrophosphate | 26.2 | 26.2 | 26.2 |
| sodium silicate ($SiO_2$:$Na_2O$ 3.2:1) | 10.1 | — | — |
| sodium silicate ($SiO_2$:$Na_2O$ 2.4:1) | — | 10.1 | — |
| sodium silicate ($SiO_2$:$Na_2O$ 2.0:1) | — | — | 10.1 |
| sodium sulfate | 42.0 | 42.0 | 42.0 |
| moisture | 2.0 | 2.0 | 2.0 |
| minors to 100% | | | |

Products K, L, and M are used at 0.12% of the wash solution to clean clay soiled Dacron Polyester fabrics at a wash temperature of 100° F.

The results at 9 grains ($Ca^{++}$:$Mg^{++}$ 3:1) are:

| K(HWU) | L(HWU) | M(HWU) |
|---|---|---|
| 24.8 | 18.0 | 16.9 |
| $LSD_{0.10} = 0.9$ | | |

The results show Product K versus L and M descend in performance as the $SiO_2$:$Na_2O$ ratio is lowered. Product B (Example I) at a much higher phosphorus content as sodium tripolyphosphate in this test scored 27.4. The $SiO_2$:$H_2O$ molar ratios for Products K, L, and M are 1.14, 1.05, and 1.0 respectively.

EXAMPLE VI

Products N and P are prepared as follows: Both N and P are prepared in an aqueous slurry, N is spray dried to the stated moisture while P remains unprocessed. The nominal compositions are:

| | N | P |
|---|---|---|
| sodium tallow alcohol sulfate | 5.5% | 5.5% |
| sodium alkyl (11.8 average) benzene sulfonate | 7.0 | 7.0 |
| sodium alkyl ($C_{14}$–$C_{16}$) triethoxy alcohol sulfate | 5.5 | 5.5 |
| sodium pyrophosphate | 26.2 | 26.2 |
| sodium sulfate | 42.0 | 42.0 |
| sodium silicate ($SiO_2$:$Na_2O$ 3.2:1) | 10.1 | 10.1 |
| moisture | 2.0 | —* |
| minors to 100% | | ** |

*moisture omitted as the product is in an aqueous slurry.
**minors in Product P are present at the same level as in N.

The products are tested as in Example I with the following results at 9 grains ($Ca^{++}$:$Mg^{++}$ 3:1):

| N(HWU) | P(HWU) |
|---|---|
| 30.9 | 15.6 |
| $LSD_{0.05} = 2.0$ | |

Product N performs significantly better when dried to the stated moisture than the components not dried (P) when used to wash the fabrics at the same dry weight concentrations (0.12% by weight). The $SiO_2$:-$H_2O$ molar ratio is 1.14 for Product N and the filtrate $SiO_2$:pyrophosphate molar ratio is about 0.6 and the filtrate $SiO_2$:sodium silicate molar ratio is about 0.5.

EXAMPLE VII

Products R and S have the following compositions:

| | R | S |
|---|---|---|
| sodium tallow alcohol sulfate | 5.5% | 5.5% |
| sodium alkyl (11.8 average) benzene sulfonic acid | 7.0 | 7.0 |
| sodium alkyl ($C_{14}$–$C_{16}$) triethoxy sulfate | 5.5 | 5.5 |
| sodium pyrophosphate | 26.2 | 26.2 |
| sodium silicate ($SiO_2$:$Na_2O$ 3.2:1) | 10.1 | 10.1 |
| sodium sulfate | 42.0 | 42.0 |
| moisture | 2.0 | 1.3 |
| minors to 100% | | |

Product R is spray dried in accordance with the present invention. Product S is spray dried without the silicate and pyrophosphate present. The compositions are tested as in Example I at 9 and 11 grains. The dried granule of Product S is added to the wash solution simultaneously with granular pyrophosphate and liquid silicate in the amounts described above. The results are:

| Hardness | R(HWU) | S(HWU) |
|---|---|---|
| 9 grains | 9.3 | 1.0 |
| 11 grains | 3.4 | 0 |
| $LSD_{0.05} = 2$ | | |

The above test shows that the silicate must be dried in the slurry to achieve the benefits of the invention.

EXAMPLE VIII

The following compositions are prepared in accordance with the present invention by spray drying in the final composition given:

| | T | U |
|---|---|---|
| $Na_{12}[AlO_2 . SiO_2]_{12} . 27 H_2O$ | 1.0% | 40.0% |
| sodium pyrophosphate | 60.0 | 5.0 |
| sodium silicate ($SiO_2$:$Na_2O$ 2.4:1) | 3.0 | 2.0 |
| sodium alkyl (13 average) benzene sulfonate | 1.0 | 50.0 |
| sodium carbonate | 16.0 | 1.0 |
| calcium carbonate | 16.0 | — |
| moisture | 3.0 | 2.0 |

Products T and U perform satisfactorily in cleaning.

EXAMPLE IX

The following are variations of the present invention:

| | V | W | X | Z |
|---|---|---|---|---|
| sodium alkyl ($C_{16}$–$C_{18}$) triethoxy sulfate | 14.9% | 40.0% | 5.0% | 3.0% |
| sodium pyrophosphate | 60.0 | 15.0 | 60.0 | 12.0 |
| sodium silicate ($SiO_2$:$Na_2O$ 1.6:1) | 25.0 | — | 1.0 | — |
| sodium silicate ($SiO_2$:$Na_2O$ 4.0:1) | — | 15.0 | — | 3.0 |
| clay | — | — | 33.6 | — |
| sodium aluminate | — | — | — | 80.0 |
| sodium borate | — | 28.0 | — | — |
| moisture | 0.1 | 2.0 | 0.4 | 2.0 |

Products V and W are prepared by agglomeration and then drying. Product X is prepared by freeze drying followed by oven drying and Z by oven drying alone.

Products V, W, X, Z perform satisfactorily.

EXAMPLE X

A detergent bar is prepared by drying and extruding and stamping the following composition:

| | |
|---|---|
| sodium alkyl benzene sulfonate (hard ABS) | 15% |
| sodium pyrophosphate | 20 |
| calcium carbonate | 50 |
| sodium silicate ($SiO_2$:$Na_2O$ 3.2:1) | 13 |
| moisture | 2 |

EXAMPLE XI

A detergent product is prepared by spray-drying a slurry having the following dry weight composition:

| | |
|---|---|
| sodium alkyl ($C_{14}$–$C_{16}$)*triethoxy sulfate | 5.5% |
| sodium alkyl ($C_{11.8}$)* LAS** | 7.0 |
| sodium tallow alcohol sulfate | 5.5 |
| sodium pyrophosphate | 24.9 |
| sodium silicate ($SiO_2$:$Na_2O$ 3.2:1) | 10.1 |
| sodium sulfate | 42.0 |
| polyethylene glycol (M.W. 6000) | 1.0 |
| moisture | 2.0 |
| Glass H*** | 1.0 |
| minors (perfumes and brightener) balance | |

*Approximate alkyl chain length.
**Linear alkyl benzene sulfonate.
***A glassy phosphate admixed into the dried product having 21 phosphorous atoms.

EXAMPLE XII

The following product is prepared by spray-drying an aqueous slurry having the following components on a finished product dry weight basis:

| | |
|---|---|
| sodium tallow alcohol sulfate | 5.5% |
| sodium alkyl (11.8 average) benzene sulfonate | 7.0 |
| sodium alkyl ($C_{14}$–$C_{16}$) triethoxy sulfate | 5.5 |
| sodium silicate ($SiO_2$:$Na_2O$ 3.2:1) | 8.0 |
| sodium pyrophosphate | 13.0 |
| sodium carbonate | 18.0 |
| sodium sulfate | 20.0 |
| moisture | 3.0 |

The dried product of the slurry is thereafter admixed with:

$$Na_{12}[AlO_2 . SiO_2]_{12} . 27 H_2O$$

to give a finished product containing 20% by weight of the alumino-silicate. The product cleans efficiently.

EXAMPLE XIII

The following products are prepared by spray drying and show the relationship of performance in clay soil removal, moisture, $SiO_2$:$H_2O$ molar ratio and the filtrate $SiO_2$:pyrophosphate molar ratio.

| Component | BB | CC | DD | EE | FF | GG |
|---|---|---|---|---|---|---|
| Sodium pyrophosphate | 26.2 | 26.2 | 26.2 | 26.2 | 26.2 | 26.2 |
| Sodium silicate ($SiO_2$:$Na_2O$) | | | | | | |
| 2.0 | 10.0 | 10.0 | — | — | — | — |
| 2.58 | — | — | 10.0 | 10.0 | — | — |
| 3.2 | — | — | — | — | 10.0 | 10.0 |
| Sodium tallow alcohol | | | | | | |

-continued

| Component | BB | CC | DD | EE | FF | GG |
|---|---|---|---|---|---|---|
| sulfate | 5.5 | 5.5 | 5.5 | 5.5 | 5.5 | 5.5 |
| Sodium $C_{11.2}$ alkyl benzene sulfonate | 7.0 | 7.0 | 7.0 | 7.0 | 7.0 | 7.0 |
| Sodium $C_{16}$ alkyl triethoxy sulfate | 5.5 | 5.5 | 5.5 | 5.5 | 5.5 | 5.5 |
| Sodium sulfate | 42.0 | 38.0 | 42.0 | 38.0 | 42.0 | 38.0 |
| Moisture | 1.8 | 6.1 | 2.3 | 6.1 | 1.8 | 7.7 |
| | ← Minors to 100 % → | | | | | |
| $SiO_2$:$H_2O$ (molar) | 1.11 | 0.33 | 0.94 | 0.35 | 1.27 | 0.30 |
| Filtrate $SiO_2$: pyrophosphate (molar) | 0.57 | 0.96 | 0.53 | 1.15 | 0.36 | 1.09 |
| Filtrate $SiO_2$: total $SiO_2$ from the sodium or potassium silicate (molar) | 0.50 | 0.85 | 0.43 | 0.94 | 0.28 | 0.84 |
| Dacron polyester HWU* (9 gr/gal) | 40.2 | 24.5 | 46.4 | 29.2 | 52.5 | 28.1 |

*Hunter Whiteness Units

In the above table, compositions BB, DD, and FF are of the present invention. The filtrate silicate to the total silicate and the pyrophosphate molar ratio, and the moisture contents are determined as hereinbefore described.

What is claimed:

1. A detergent composition prepared by the process of:

1. forming an aqueous slurry comprising
   a. from about 2 to about 20% on a dry weight basis of an alkali metal silicate having the formula $SiO_2$:$M_2O$, wherein the $SiO_2$:$M_2O$ weight ratio is from about 2.4:1 to about 4:1, and M is an alkali metal or mixtures thereof;
   b. from about 9 to about 50% on a dry weight basis of an alkali metal pyrophosphate having the formula $M_xH_y$ $(P_2O_7)$ and the sum of $x + y$ are integers equal to 4; M is an alkali metal or mixtures thereof;
   c. from about 0.1 to about 80% on a dry weight basis of a diluent selected from the group consisting of natural and synthetic clays, alkali metal carbonates, bicarbonates, and sesquicarbonates, borates, perborates, sulfates, chlorides, bisulfates, aluminates, and calcium carbonate, and mixtures thereof;
   d. from about 5 to about 40% on a dry weight basis of an anionic, nonionic, zwitterionic, or ampholytic detergent and mixtures thereof; then,
2. spray drying the slurry of (1) to form an alkaline solid granular detergent composition characterized in that when 1.2 grams of the alkaline solid granular detergent composition are added to one liter of distilled water at 25° C, agitated for one minute to avoid lumping, and filtered through a 142 mm diameter, five micron pore size filter under nitrogen at 6.8 atmospheres pressure, the molar ratio of the filtrate $SiO_2$ to the total $SiO_2$ from the silicate in the complete alkaline detergent composition is no more than about 3.3:4, and
3. admixing from about 0 to about 60% on a dry weight basis of the material described in (1)(b) to give a detergent composition combining from about 12% to about 45% by weight $M_4(P_2O_7)$ wherein M is an alkali metal;

wherein the total amount of alkali metal tripolyphosphate present is less than about 20% by weight of the total pyrophosphate present and wherein the total detergent composition contains from about 0.1% to about 4% by weight of a glassy phosphate of the formula $$(M_2O)_x(P_2O_5)_y$$

wherein $y$ is from about 5 to 50 and the ratio of y:x is from about 1:1 to about 1:1.5 and M is an alkali metal.

2. The detergent composition of claim 1 wherein the spray drying is carried out in a multilevel spray-drying operation.

3. The detergent composition of claim 1 wherein the alkali metal pyrophosphate and the alkali metal silicate are the sodium salts thereof.

4. The composition of claim 1 wherein the glassy phosphate has 14 or 21 phosphorus atoms.

5. The detergent composition of claim 1 additionally comprising from about 1 to about 40% on a dry weight basis of a synthetic water-insoluble hydrated alumino silicate of the formula $Na_z[(AlO_2)_z.\ (SiO_2)_y]xH_2O$, wherein $z$ and $y$ are integers of at least 6; the molar ratio of $z$ to $y$ is in the range from 1.0 to about 0.5, and $x$ is an integer from about 15 to about 264; said aluminosilicate ion exchange material having a particle size diameter from about 0.1 micron to about 100 microns; a calcium ion exchange capacity of at least about 200 mg. eq/g; and a calcium ion exchange rate of at least about 2 grains/gallon/minute/gram.

6. The detergent composition of claim 1 additionally comprising from about 1 to aabout 40% on a dry weight basis of an amorphous aluminosilicate of the formula $Na_x(xAlO_2.\ ySiO_2)$, wherein $x$ is an integer of from 1 to 1.2, and $y$ is 1, said aluminosilicate ion exchange material having a magnesium ion exchange capacity of from about 50 mg eq. $CaCO_3$/g to about 150 mg eq. $CaCO_3$/g.

7. The detergent composition of claim 1 wherein the detergent component is anionic.

8. The detergent composition of claim 7 wherein the anionic detergent is selected from the group consisting of the alkali metal and substituted-ammonium, alkyl ether sulfates, alkyl sulfates, alkyl benzene sulfonates, and the salts of α-sulfocarboxylic acids and mixtures thereof.

9. The detergent composition of claim 1 wherein the molar ratio of the filtrate $SiO_2$ to the silicate is less than about 3:4 and the molar ratio of the filtrate $SiO_2$ to the pyrophosphate is less than about 0.9.1.

10. The detergent composition of claim 1 wherein the weight ratio of the alkali metal silicate to the alkali metal pyrophosphate is about 1.30 to about 4:1.

11. The detergent composition of claim 1 wherein the diluent is selected from the group consisting of alkali metal carbonates, bicarbonates, sesquicarbonates, chlorides, borates, perborates, sulfates, bisulfates, and aluminates, calcium carbonate, and clays, and mixtures thereof at a level of from about 1 to about 55% by weight.

12. The detergent composition of claim 11 wherein the diluent salt is selected from the group consisting of the alkali metal carbonates, bicarbonates, sesquicarbonates, and sulfates and mixtures thereof.

13. The detergent composition of claim 1 wherein the composition formed in step (2) has a moisture content of less than about 5%.

14. The detergent composition of claim 1 wherein the composition of step (2) has a moisture content of from about 0.1 to about 3.5% by weight.

15. The composition of claim 1 wherein the composition of step (2) has an $SiO_2$:$H_2O$ molar ratio of greater than about 0.5.

16. The detergent composition of claim 15 wherein the $SiO_2$:$H_2O$ molar ratio is greater than 0.8.

17. The detergent composition of claim 1 wherein said glassy phosphate is added in step (3).

18. A process for forming a detergent composition comprising the steps of:

1. forming an aqueous slurry comprising
   a. from about 2 to about 20% on a dry weight basis of an alkali metal silicate having the formula $SiO_2$:$M_2O$, wherein the $SiO_2$:$M_2O$ weight ratio is from about 2.4:1 to about 4:1, and M is an alkali metal or mixtures thereof;
   b. from about 9 to about 50% on a dry weight basis of an alkali metal pyrophosphate having the formula $M_xH_y$ $(P_2O_7)$ and the sum of $x + y$ are integers equal to 4; M is an alkali metal of mixtures thereof;
   c. from about 0.1 to about 80% on a dry weight basis of a diluent selected from the group consisting of natural and synthetic clays, alkali metal carbonates, bicarbonates, and sesquicarbonates, borates, perborates, sulfates, chlorides, bisulfates, aluminates, and calcium carbonate, and mixtures thereof;
   d. from about 5 to about 40% on a dry weight basis of an anionic, nonionic, zwitterionic, or ampholytic detergent and mixtures thereof; then,
2. spray drying the slurry of (1) to form an alkaline solid granular detergent composition characterized in that when 1.2 grams of the alkaline solid granular detergent composition are added to one liter of distilled water at 25° C, agitated for one minute to avoid lumping, and filtered through a 142 mm diameter, five micron pore size filter under nitrogen at 6.8 atmospheres pressure, the molar ratio of the filtrate $SiO_2$ to the total $SiO_2$ from the silicate in the complete alkaline detergent composition is no more than about 3.3:4, and
3. admixing from about 0 to about 60% on a dry weight basis of the material described in (1)(b) to give a detergent composition containing from about 12 to about 45% by weight $M_4(P_2O_7)$ wherein M is an alkali metal;

wherein the total amount of alkali metal tripolyphosphate present is less than about 20% by weight of the total pyrophosphate present and wherein the total detergent composition contains from about 0.1 to about 4% by weight of a glassy phosphate of the formula $$(M_2O)_x(P_2O_5)_y$$

wherein $y$ is from about 5 to 50 and the ratio of $y$:$x$ is from about 1:1 to about 1:1.5 and M is an alkali metal.

* * * * *